United States Patent [19]

Gunderson

[11] 4,011,668

[45] * Mar. 15, 1977

[54] ADJUSTABLE DEFLECTOR FOR SNOW REMOVAL MACHINE

[76] Inventor: Ralph R. Gunderson, 8212 S. Homan, Chicago, Ill. 60652

[ * ] Notice: The portion of the term of this patent subsequent to Feb. 25, 1992, has been disclaimed.

[22] Filed: Mar. 3, 1975

[21] Appl. No.: 554,539

Related U.S. Application Data

[63] Continuation-in-part of Ser. No. 337,918, March 5, 1973, Pat. No. 3,879,866.

[52] U.S. Cl. ..... 37/43 R; 214/42 A; 302/59

[51] Int. Cl.[2] ..... E01H 5/04

[58] Field of Search ..... 37/43 A, 43 R, 43 B; 302/59–61, 34; 214/42 R, 42 A

[56] References Cited

UNITED STATES PATENTS

| | | | |
|---|---|---|---|
| 2,496,472 | 2/1950 | Huddle | 214/42 A |
| 2,741,512 | 4/1956 | Stott et al. | 302/61 |
| 2,778,510 | 1/1957 | Mayhill et al. | 214/42 A |
| 2,971,279 | 2/1961 | Blanchet | 37/43 B |
| 3,299,546 | 1/1967 | Ibisch | 37/43 B |
| 3,357,749 | 12/1967 | Seymour et al. | 302/60 |
| 3,446,372 | 5/1969 | Roach | 302/60 X |
| 3,451,725 | 6/1969 | Waldrop | 302/61 X |
| 3,510,171 | 5/1970 | Bacon | 37/43 R X |
| 3,867,773 | 2/1975 | Gunderson | 37/43 R |
| 3,879,866 | 4/1975 | Gunderson | 37/43 R |

FOREIGN PATENTS OR APPLICATIONS

| | | | |
|---|---|---|---|
| 634,485 | 2/1962 | Italy | 302/61 |

*Primary Examiner*—Edgar S. Burr
*Assistant Examiner*—Steven A. Bratlie
*Attorney, Agent, or Firm*—Wegner, Stellman, McCord, Wiles & Wood

[57] ABSTRACT

In a snow removal machine, an adjustable snow directional discharge device having an upwardly directed snow discharge chute rotatable about an upright axis of rotation, a deflector pivotally mounted on the upper end of the chute, a retractor urging the deflector towards an upper position, a support bracket having a fixed bearing surface mounted on the axis of rotation of the chute, and a means for adjusting the deflector to lower positions including a lever secured to the deflector and a control cable extending between the lever and a rearward control station and passing over the bearing surface.

5 Claims, 5 Drawing Figures

ADJUSTABLE DEFLECTOR FOR SNOW REMOVAL MACHINE

CROSS REFERENCE TO RELATED APPLICATION

This is a continuation-in-part of my copending patent application Ser. No. 337,918, filed Mar. 5, 1973, entitled "Mechanism for Adjusting Deflector for Discharge Chute of Snow Removal Machine," now U.S. Pat. No. 3,879,866, issued Apr. 29, 1975.

BACKGROUND OF THE INVENTION

The present invention relates to a snow discharge device in a snow removal machine, and more particularly to a means for adjusting a pivotally mounted deflector at the upper-end of a discharge chute in a snow removal machine.

The function of a snow removal machine is to remove large amounts of snow particles from one area and to deposit them in another. When the machine is used in tight quarters, for instance, the snow particles must be directed forwardly of the machine. At other times, it may be necessary to direct the snow particles laterally of the machine, sometimes over and beyond obstacles or other obstructions, and sometimes into a head wind or a side wind.

There are various commercially available power-operated snow removal machines which include a snow gathering housing at the front of a two-wheel or four-wheel chassis with rotatable snow removal blades for forcing snow particles into an upwardly directed snow discharge chute which is rotatable about an upright axis. The upper end of the snow discharge chute includes a pivotally mounted deflector, and angular adjustment of the chute enables snow discharge to one side or the other of the path of movement.

The operator of such a snow removal machine must safely direct the prime mover, set an appropriate angle on the deflector so that a head wind or a side wind will not inundate him with snow, and control the rotation of the chute so that the path of emitted snow particles will be deposited in their intended place. It is frequently necessary to make immediate and effective adjustments to the chute and/or to the deflector so that the snow particles can be immediately directed in their intended path. When operating in extremely windy conditions, immediate and accurate deflector adjustments are frequently needed, or a head wind may inundate the operator of the mechanism with the snow particles which are being cleared. In addition, when a snow removal device is being used closely adjacent to a hedge or to walls, to buildings or other obstructions or obstacles, it is frequently necessary to take immediate and effective measures to adjust the path of the snow particles so that the snow particles may be directed in either a horizontal path to the side or in an arcuate path over and beyond the obstacles. In the northern states, where snow on the level may accumulate to a depth of three to four feet, successful snow plowing necessitates throwing newly fallen snow over accumulated banks of snow which become small hills before the winter months are over.

In the past, it has been conventional to provide manually accessible means adjacent the operator's control station for angularly adjusting the discharge chute. On the other hand, it has not always been usual to provide remote control means for adjusting the deflector from the operator's control station. Instead, it has often been a requirement that the deflector must be adjusted locally at the position of its mounting to the chute. However, such local adjustment requires that operation of the machine be discontinued and the machine switched off, since the moving snow removal blades or rotating snow removal screw presents a serious potential hazard to the operator's person. In addition, local adjustment places the operator in the path of potentially hazardous materials normally being projected through the chute. Having to cease operation in order to manually perform adjustments is inefficient and completely unnecessary.

In some machines, however, provision has been made for adjustment of the discharge deflector remotely from an operator's control station. For example, U.S. Pat. No. 2,971,279 relates to a rotary snow plow in which a deflector is adjustable by a loose cable arranged in a cable guide which is offset from the axis of rotation of the chute. U.S. Pat. No. 3,299,546 relates to a rotary snow plow with cable means for adjusting a deflector on a discharge chute, including a loose cable on a stationary cable guide pulley and additional guide rollers for holding the cable on the pulley when the chute is angularly directed toward opposite sides of the machine. U.S. Pat. No. 3,510,171 relates to a snow removing machine in which a deflector is adjustable by a Bowden cable in a sheath. U.S. Pat. No. 2,741,512 relates to a forage harvester with an adjustable deflector controlled by a cable mechanism held by a ratchet device.

There are, however, various inherent disadvantages associated with the deflector adjustment remote controls of the type described above. The prior art fails to show a means for maintaining a preselected horizontal elevation of the deflector whenever the chute to which it is attached has been rotated with respect to the chassis of the snow removing machine. Whenever the direction of the chute is changed, the deflector is also changed, which thereby results in a change in the altitude of the snow particles which are expelled.

My U.S. Pat. Nos. 3,867,773 and 3,879,866 each show a related structure for controlling the adjustment of a deflector in such manner that angular chute adjustment does not alter the selected position of deflector adjustment.

SUMMARY OF THE INVENTION

It is, therefore, a general object of the present invention to provide a new and improved mechanism for adjusting a deflector pivoted at the upper end of a rotatable discharge chute in a snow removal machine wherein provision is made for adjustment of the deflector in all angular positions of the discharge chute, wherein the adjustment mechanism is able to perform without malfunction in the most inclement weather and wherein the deflector is adjustable through a substantial number of vertical elevations.

A more specific object of the present invention is to provide a new and improved deflector adjusting mechanism of the type described wherein the angular rotation of the discharge chute does not affect the set elevation of the deflector.

The present invention provides an adjustable deflector mechanism which is regulated to maintain the same deflector adjustment regardless of whether the chute and deflector have been rotated to direct the snow particles laterally to the right, forwardly, or laterally to the left of the snow removal device. In other words, once the deflector position is set in a preselected position of angular adjustment, the deflector will maintain this position as the chute is rotated to the right or to the left.

It is a further object of the present invention to provide a simplified and less expensive deflector adjusting mechanism of the type described wherein the elevation of the deflector may be remotely controlled at a control station which is situated away from the hazardous area of operation.

It is another object of the present invention to provide a new and improved deflector adjusting mechanism of the type described including an upwardly biased deflector pivoted to a rotatable discharge chute, a support bracket mounting a bearing surface along the upright axis of a rotatable discharge chute, a single control cable secured at one end to the deflector, passing through the bearing surface, and secured at its other end to a control station so that the elevational angle of the deflector is changed by adjusting the end of the cable at the control station.

DETAILED DESCRIPTION OF ILLUSTRATED EMBODIMENTS

Figure 1:
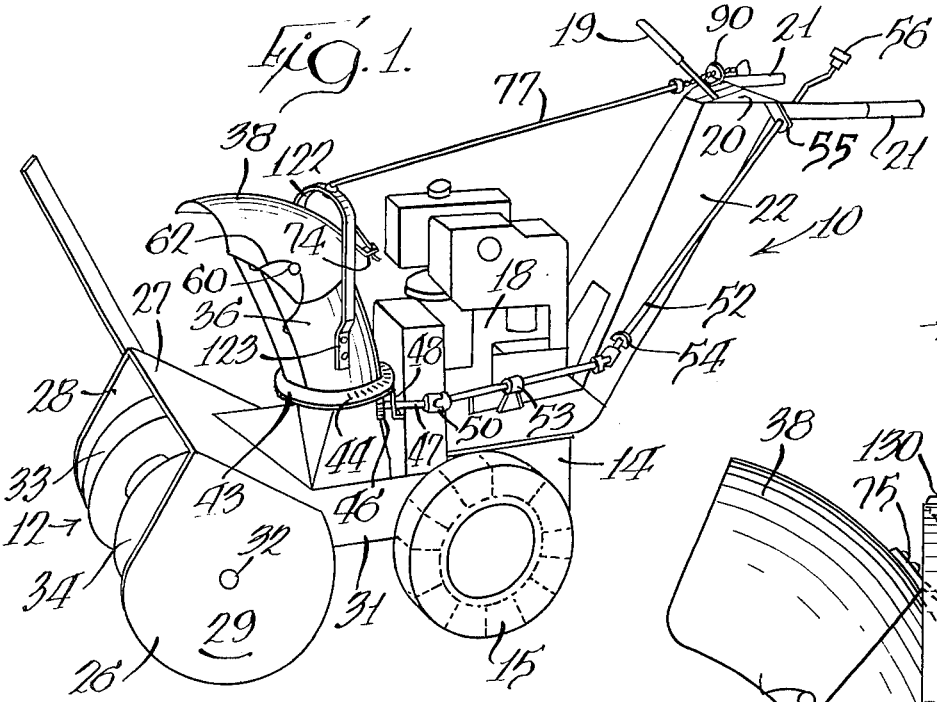
FIG. 1 is a perspective view of a snow removal machine having a deflector adjustment mechanism embodying the principles of the present invention.

Referring to FIG. 1, the invention is illustrated in connection with a snow removal machine 10 having a power operating snow removal mechanism 12 at the front of the machine. The machine 10 includes a chassis 14 supported on propelling wheels as at 15. There is a prime mover in the form of a gasoline engine 18 on the chassis 14 connected to drive an appropriate transmission connected for rotating the propelling wheels 15. The engine is adapted to be started by hand and automatically controlled to maintain appropriate power for handling the load encountered in a conventional manner.

Transmission of power from the engine 18 to the propelling wheels 15 and to the snow removal mechanism may be controlled by a manually accessible handle 19 located at a control panel or station 20 disposed between a pair of handles 21 which may be utilized for steering the machine. The handles 21 are rigidly secured to the chassis 14 and extend upwardly from the chassis to a housing 22 and terminate in hand grip portions adjacent the control station 20.

The snow removal mechanism 12 includes a snow gathering housing 26 extending transversely at the front of the machine and defining the width of a swath to be cut by the snow removal mechanism. The housing includes a rear wall (not visible), a top wall 27, and end walls as at 28 and 29. The front of the housing 26, and the bottom, are largely open to facilitate entry of snow into the front of the housing. As illustrated, the housing 26, as well as the mechanism carried thereby, is supported at the front end of a frame 31 which may extend rigidly forwardly from the chassis 14.

In order to collect and remove snow in a predetermined path as the machine progresses, the housing 26 includes appropriate rotary blade mechanism rotatably mounted as at 32 in opposite end walls 28 and 29. Preferably, the blade mechanism in the housing 26 includes oppositely directed blade portions 33 and 34 at opposite ends of the housing for moving snow particles inwardly toward the mid-portion of the housing where they are directed upwardly to a chute 36. If desired, there may be a second stage blower or fan in the housing 26 associated with the chute 36 for forcing the gathered snow particles upwardly at a high rate of speed so that, in effect, the snow particles are thrown or blown with great force outwardly through the chute 36 in a direction determined by the angular adjustment of the chute 36 and a deflector 38 mounted at the upper end of the chute 36.

As will subsequently be seen, the snow removal mechanism 12 is provided with a structure to direct the snow particles forwardly, to the right, or to the left of the snow removal machine through a horizontal angle of approximately 180°, and a structure is also provided to vary the angular direction of the snow particles from the horizontal (in other words, a vertical angular adjustment) so that the snow particles can be thrown at any angle desired during operation of the snow removal machine.

Figure 2:
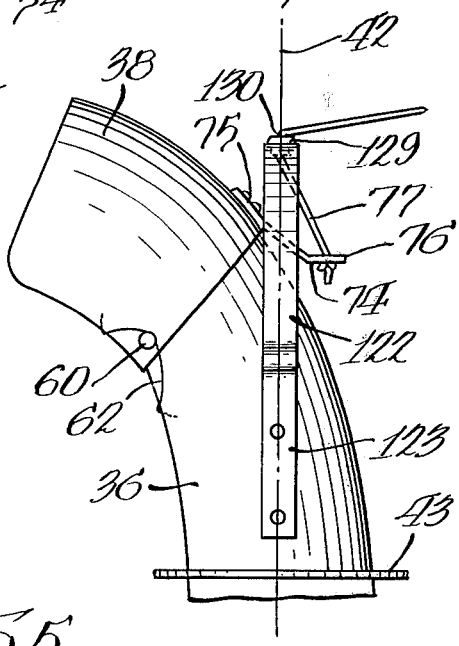
FIG. 2 is an enlarged side elevational view illustrating the deflector adjustment mechanism shown in FIG. 1.
Figure 3:
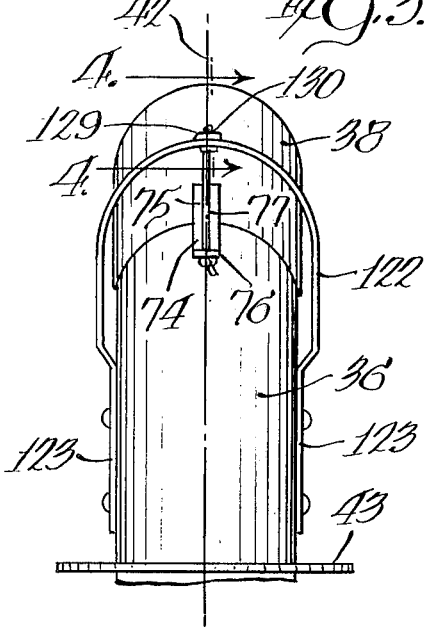
FIG. 3 is a rear elevational view of the mechanism shown in FIG. 2.
Figure 4:
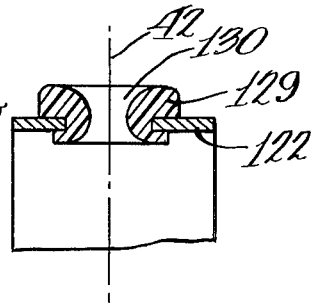
FIG. 4 is an enlarged fragmentary section view taken along the line 4—4 of FIG. 3.

In order to provide for direction of the discharged snow particles toward one side or the other of the path of movement of the machine 10, the upright snow discharge chute 36 is mounted for rotation on the housing 26 about an upright axis which is designated at 42, as seen in FIGS. 2 and 3. The lower end of the chute 36 includes an annular, outwardly extending flange 43 which is disposed transverse to the axis 42 and which has a plurality of apertures 44 adapted to be engaged by a toothed wheel 46 secured on a shaft 47, rotatably mounted in a bracket 48, fixed on the chassis 14.

In order to angularly adjust the chute 36 remotely at the operator station, the rotatable shaft 47 has a universal connection at 50 with an angulated shaft 52 supported in guides 53, 54 and 55 on the chassis 14. The angulated shaft 52 terminates at the upper end in a handle 56 which is accessible at the operator station. As illustrated in the drawings, while the chute 36 is angularly adjustable about an upright axis 42, the chute actually is curved relative to the axis 42 for purposes of directing snow particles to one side of the axis 42 depending upon the angular adjustment of the chute. Thus, through the medium of the angulated drive shaft 47, 52 and the toothed gear wheel 46, the operator may turn the chute within a range of approximately 180° from one extreme position where the snow particles are directed laterally toward the left side of the machine to another extreme position where the snow particles are directed laterally toward the right side of the machine.

As thus far described, the snow removal machine is a standard commercially available product, and need not be further described in specific detail. According to the present invention, in order to control the vertical angle at which the snow particles and ice are discharged from the end of the chute 36, provision is made for adjusting the deflector 38 about a horizontal axis relative to the chute, to turn the deflector more or less upwardly or downwardly relative to the chute, so that the snow particles are discharged at a higher or lower angle.

The deflector 38 is essentially an inverted, channel-shaped member which has approximately a half-circular, transverse, cross-sectional configuration, and a longitudinal axis which is somewhat curved in a degree of curvature corresponding approximately to the curvature of the chute 36. At opposite edges, near the lower end, the deflector 38 is pivotally mounted on the chute 36 by means of pivot pins 60. Associated with each of the pivotal joints 60, there is a torsion spring 62 in the form of a wire-shaped member having a central portion wrapped around the pivot pin 60 and opposite ends hooked respectively on the chute 36 and the deflector 38 in a manner such that the spring 62 functions to bias the deflector upwardly relative to the chute toward a relatively open position where the snow particles would be permitted to discharge in an upward direction. In order to provide for adjustment of the deflector remotely, so that the operator may control the position of the deflector at the operator station, to direct discharge at a lower angle, or a higher angle, a remote control mechanism is connected to the deflector 38 and adjustable from the operator station.

The remote control mechanism affords a means for selectively adjusting the deflector 38 and includes a cable attachment lever means or arm 74 having an end portion secured to the deflector at 75. From the mounting 75, the arm 74 extends downwardly behind the chute to a lower terminus 76 to which a cable 77 is attached. As herein used, control cable 77 is intended to be used in its broadest meaning, that is, any elongated flexible rope whether of metal or synthetic or natural occurring material, is intended to come within the purview of the term "cable".

In the preferred embodiment, and as a part of the remote control mechanism, a cable support bracket 122 of inverted U-shaped configuration is provided. Means for mounting the bracket 122 is afforded by bracket lower end portions secured at 123 to opposite sides of the chute 36. At its upper central portion, the bracket 122 is provided with a centrally located cutout portion, generally designated 129, which affords a bearing surface and guide for the cable 77. In the preferred form, the cutout portion is in the form of a centrally located aperture which preferably carries a lining, such as a grommet or eyelet 130, of suitable bearing material, such as plastic material, in the form of nylon or teflon, to afford a bearing surface of friction inhibiting material. While it is preferred that the cutout portion be in the form of an aperture, it is clear that the cutout portion could also take the form of a forwardly disposed notch in the upper central portion of the bracket 122 and that such a notch could be annular or with a plurality of sides.

In the remote control mechanism, the deflector adjustment control cable 77 is secured at 76 to the free end of the lever means 74 as previously explained. The cable 77 is then passed upwardly about the bearing surface of the cutout portion (preferably through the aperture and grommet 130) and then the cable 77 is led rearwardly to a position near the control panel or station 20. The rear end of the cable 77 is suitably secured to an adjustable lock device 90 adjacent the operator station. Thus, the cable 77 can be selectively held in various positions of adjustment by the lock device 90 as desired.

Importantly, to the primary object of the present invention, the bracket 122 is mounted so as to position the bearing surface of the grommet 130 in a position of alignment with the axis 42 about which the chute 36 is angularly adjustable.

This positioning of the bearing surface enables an operator to preselect a position of angular adjustment (vertically) of the deflector and to maintain this vertical angle of adjustment as the chute is rotated to the right or to the left through the entire range of approximately 180°. Stated another way, by positioning the bearing surface on the axis of rotation of the chute, the cable end secured to the lever means of the deflector will be carried always on a uniform radius about the axis of rotation of the chute as the chute is rotated. Thus, there is no lengthening or shortening of the cable leading from the bearing surface to the deflector which would affect the adjustment of the deflector during any rotation of the chute within its operative range.

Preferably, the cable tends to act upon the deflector so as to move it downwardly, and since the cable tension holds the deflector in position during operation, then the deflector is completely stable as rapidly moving snow particles are intercepted and redirected by the deflector. And, since the spring means urges the deflector toward its upper position, a single cable can be used to control the entire range of angular adjustment of the deflector.

Preferably also, the bracket or lever 74 is secured to the deflector and extends transversely in relation to the axis of rotation of the chute. Thus, the regulator for the deflector is provided with increased mechanical advantage which enhances ease of operation of the cable in controlling the deflector angle and also permits increased spring action on the deflector so that snow particles and ice are not likely to interfere with deflector operation and regulation under inclement weather and other severe conditions. Regardless of angular rotation of the chute 36 throughout its operative range, substantially the same increased mechanical advantage is maintained for control of pivotal movement of the deflector.

Figure 5:
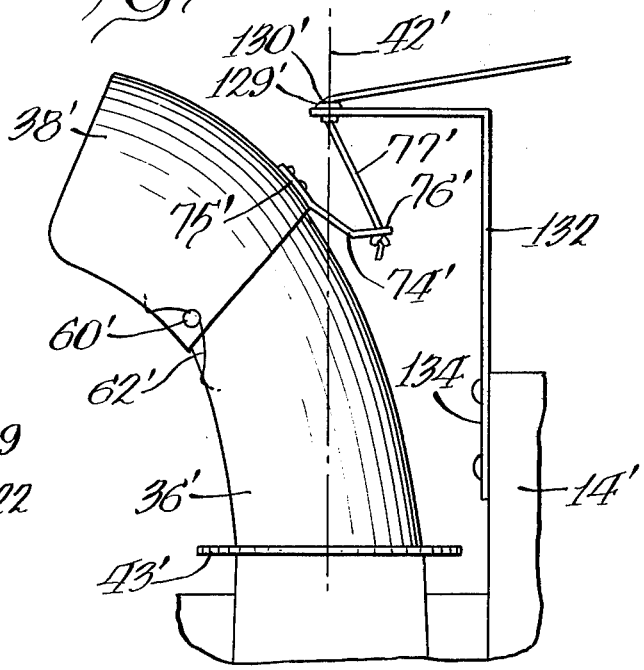
FIG. 5 is a side elevational view of another embodiment in which the support bracket differs from that illustrated in FIGS. 1–3.

Referring now to the embodiment of FIG. 5, an alternative mounting of the support bracket is shown. To simplify the description, parts corresponding to similar previously described parts in FIGS. 1–4 have been designated with similar reference numerals bearing a prime suffix. The modification shows an L-shaped support bracket 132 mounted at 134 on the chassis 14'. However, the cutout portion, generally designated 129', which affords a bearing surface and guide for the control cable 77', is still positioned in alignment with the upward axis 42' about which the discharge chute 36' rotates. Hence, the operation of the deflector adjusting mechanism is unchanged even though modified.

While the invention has been illustrated in connection with a two-wheel tractor, the invention, of course, may be used with other structures which direct the snow removal machine. Also, the term "control station" is used to refer to the vicinity of a control panel or other area where the tractor controls are located, whether in a two-wheel or four-wheel machine.

I claim:

1. In a snow removal machine, an adjustable snow directional device for directing snow particles forwardly and laterally of the machine, comprising:

an upright chute for receiving snow particles from the machine and directing said particles upwardly to an open upper end of said chute, said chute being rotatable about an upright axis of rotation;

a deflector pivoted to the chute for swinging movement between an upper position and a lower position, the deflector being positioned transversely of the open upper end of the chute to intercept and to redirect snow particles outwardly of the open upper end of the chute, the swinging movement of the deflector between said upper and lower positions varying the direction of the path of snow particles from the chute;

retracting means normally urging the deflector toward said upper position;

a support bracket;

a stationary surface carried by the bracket;

means for mounting the bracket to position the bearing surface on the axis of rotation of the chute; and means for selectively adjusting the deflector toward said lower position, the adjusting means including lever means on the deflector extending transversely of the axis of rotation of the chute, and a single, elongated, flexible control cable extending to a control station, said control cable having an attaching portion secured to said lever means and passing rearwardly over the bearing surface on the bracket, whereby movement of said control cable to counteract said retracting means will pivot said deflector downwardly to a preselected position of adjustment, and rotation of the chute about its axis of rotation will swing said attaching portion on a uniform radius about said axis of rotation so that the deflector is maintained in said preselected position of adjustment during said rotation.

2. An adjustable snow directional device as specified in claim 1 in which the bearing surface has a friction inhibiting lining.

3. An adjustable snow directional device as specified in claim 1 in which the bearing surface is annularly shaped.

4. An adjustable snow directional device as specified in claim 1 in which the bearing surface is in the form of an aperture in the bracket.

5. An adjustable snow directional device as specified in claim 1 in which the bearing surface portion is in the form of an aperture in the bracket and a grommet of friction inhibiting material is positioned to form a lining within the aperture.

* * * * *